US012338817B2

(12) United States Patent
Deville et al.

(10) Patent No.: US 12,338,817 B2
(45) Date of Patent: Jun. 24, 2025

(54) REAR DRIVE EGR PUMP

(71) Applicant: Eaton Intelligent Power Limited, Dublin (IE)

(72) Inventors: Nathan Deville, Marshall, MI (US); Brandon Biller, Ferndale, MI (US); Michael Coates, Marshall, MI (US); Leo Weeks, Olivet, MI (US); Anandha Krishnan C, Kerala (IN); Giridhar Jambare, West Mumbai (IN); Vinay Kelkar, Pune (IN)

(73) Assignee: Eaton Intelligent Power Limited, Dublin (IE)

( * ) Notice: Subject to any disclaimer, the term of this patent is extended or adjusted under 35 U.S.C. 154(b) by 19 days.

(21) Appl. No.: 18/043,861

(22) PCT Filed: Sep. 2, 2021

(86) PCT No.: PCT/EP2021/025330

§ 371 (c)(1),
(2) Date: Mar. 2, 2023

(87) PCT Pub. No.: WO2022/048797

PCT Pub. Date: Mar. 10, 2022

(65) Prior Publication Data

US 2023/0258179 A1 Aug. 17, 2023

Related U.S. Application Data

(60) Provisional application No. 63/126,237, filed on Dec. 16, 2020, provisional application No. 63/073,514, filed on Sep. 2, 2020.

(51) Int. Cl.

| | |
|---|---|
| ***F04C 18/12*** | (2006.01) |
| ***F04C 29/00*** | (2006.01) |
| ***F04C 29/02*** | (2006.01) |

(52) U.S. Cl.
CPC ..... *F04C 18/126* (2013.01); *F04C 29/0042* (2013.01); *F04C 29/02* (2013.01); *F04C 2240/40* (2013.01); *F04C 2240/50* (2013.01)

(58) Field of Classification Search
CPC .... F04C 18/126; F04C 29/0042; F04C 29/02; F04C 2240/40; F04C 2240/50; F04C 29/04–047; F04C 15/0057; F04C 29/005
See application file for complete search history.

(56) References Cited

U.S. PATENT DOCUMENTS 2,755,990 A * 7/1956 Nilsson ..... F04C 18/16 418/199
6,315,535 B1 * 11/2001 Hoshi ..... F04C 28/28 418/2

(Continued)

FOREIGN PATENT DOCUMENTS

CN 100543308 C * 9/2009 ..... F04C 18/16
CN 104405638 A * 3/2015 ..... F04C 18/126

(Continued)

OTHER PUBLICATIONS

International Search Report and Written Opinion for PCT/EP2021/025330, mailed Dec. 22, 2021.

*Primary Examiner* — Alexander B Comley
(74) *Attorney, Agent, or Firm* — Merchant & Gould P.C.

(57) ABSTRACT

An exhaust gas recirculation pump for an internal combustion engine that includes an electric motor assembly having an electric motor disposed within an electric motor housing. A roots device is coupled to the electric motor. The roots device includes a housing defining an internal volume. Rotors are disposed in the internal volume and connected to the electric motor. A bearing plate is attached to the housing wherein the bearing plate and an outer cover attached to the bearing plate defines an oil cavity. A transmission assembly (Continued)

is positioned on an opposing side of the housing relative to the electric motor and in the oil cavity.

17 Claims, 17 Drawing Sheets

(56) References Cited

U.S. PATENT DOCUMENTS 7,255,541 B2 * 8/2007 Kuramoto ..... F04C 28/06 417/410.3
2002/0172612 A1 * 11/2002 Okada ..... F04C 29/04 418/101
2003/0059325 A1 * 3/2003 Adams ..... F04C 18/126 418/206.1
2003/0147764 A1 * 8/2003 Kreihn ..... F04C 18/16 418/88
2005/0112014 A1 * 5/2005 Shiromaru ..... F04C 29/0092 418/206.4
2008/0304981 A1 * 12/2008 Chuang ..... F04C 29/0042 417/410.4
2009/0047163 A1 * 2/2009 Fujita ..... H01M 8/04089 418/206.1

FOREIGN PATENT DOCUMENTS

DE 102006000512 A1 * 6/2007 ..... F04C 18/084
EP 1811181 A1 * 7/2007 ..... F04C 18/126
EP 2182215 A2 * 5/2010 ..... B23P 19/10
JP S62200188 U * 12/1987 ..... F04C 18/18
JP 4-43891 2/1992
JP 2003247495 A * 9/2003 ..... F04C 29/0071
JP 2007154799 A * 6/2007
JP 2009250219 A * 10/2009
WO WO-2016133854 A1 * 8/2016 ..... F02B 39/10
WO WO-2019141766 A1 * 7/2019 ..... F02B 33/34

* cited by examiner

REAR DRIVE EGR PUMP

CROSS-REFERENCE TO RELATED APPLICATIONS

This application U.S. National Stage Application of PCT International Patent Application No. PCT/EP2021/025330, filed Sep. 2, 2021, which claims priority to U.S. provisional application No. 63/073,514 filed on Sep. 2, 2020; and U.S. provisional application No. 63/126,237 filed on Dec. 16, 2020, which applications are incorporated herein by reference. To the extent appropriate, a claim of priority is made to each of the above-disclosed applications.

FIELD OF THE INVENTION

The invention relates to exhaust gas recirculation (EGR) pumps and control of EGR pumps.

BACKGROUND OF THE INVENTION

There are many previously known automotive vehicles that utilize internal combustion engines such as diesel, gas or two stroke engines to propel the vehicle. In some constructions EGR (exhaust gas recirculation) recirculates the exhaust gas into the engine for mixture with the cylinder charge. The EGR that is intermixed with the air and fuel to the engine enhances the overall combustion of the fuel. This, in turn, reduces exhaust gas emissions.

By including a separate EGR pump an increase in fuel economy may be achieved in comparison to prior art systems that may use a turbocharger to drive an EGR flow with the addition of costly EGR valves. Additionally, a separate EGR pump provides full authority of the EGR flow rate. In a diesel application, a separate EGR pump may allow for removal of an EGR valve and replace a complicated variable geometry turbocharger with a fixed geometry turbocharger optimized for providing a boosted air charge. The separate EGR pump may provide reduced engine pumping work and improved fuel economy.

One disadvantage of intermixing exhaust gas is that the exhaust gas contains particulate matter such as soot. Water vapor may be included in exhaust gases from an engine as a result of the combustion process of fuel supplied to the engine. Generally, the water vapor is expelled to the environment through an exhaust system. However in an EGR application a portion of the exhaust is recirculated to the engine intake manifold. The water vapor may provide a carrier for particulate matter such as soot. Soot deposits may accumulate on various components degrading performance.

It is therefore desirable to provide an EGR pump that resists accumulation of soot deposits. It is also desirable to provide a separate EGR pump that transports EGR gases to prevent degradation of the additional components such as a supercharger or turbocharger.

Various portions of EGR pumps may be exposed to exhaust gases at elevated temperatures. For example the rotors associated with the pump may contact exhaust gases at temperatures such as from 220 to 300 C. In such a scenario, the high temperature may demagnetize the components of the electric motor causing a loss of torque. Additionally, the high temperature may adversely affect the mechanical components of the EGR pump such as varying the heat treatments and properties of the materials.

It is therefore desirable to reduce heat transfer from the EGR pump rotors to the electric motor that drives the EGR pump. There is therefore a need in the art to thermally isolate rotors of an EGR pump from an electric motor that may drive the pump such that the motor does not overheat.

Further, it is desirable to cool and lubricate the various components of the EGR pump for safe and long operation in an EGR environment.

SUMMARY OF THE INVENTION

In one aspect there is disclosed, an exhaust gas recirculation pump for an internal combustion engine that includes an electric motor assembly having an electric motor disposed within an electric motor housing. A roots device is coupled to the electric motor. The roots device includes a housing defining an internal volume. Rotors are disposed in the internal volume and connected to the electric motor. A transmission assembly includes a drive gear attached to the rotor that is coupled to the electric motor. The transmission assembly includes a driven gear meshed with the drive gear, the driven gear is coupled to the other rotor. The transmission assembly is positioned on an opposing side of the housing relative to the electric motor.

In another aspect there is disclosed, an exhaust gas recirculation pump for an internal combustion engine that includes an electric motor assembly having an electric motor disposed within an electric motor housing. A roots device is coupled to the electric motor. The roots device includes a housing defining an internal volume. Rotors are disposed in the internal volume and connected to the electric motor. A bearing plate is attached to the housing wherein the bearing plate and an outer cover attached to the bearing plate defines an oil cavity. A transmission assembly is positioned on an opposing side of the housing relative to the electric motor and in the oil cavity.

DETAILED DESCRIPTION

Figure 1:
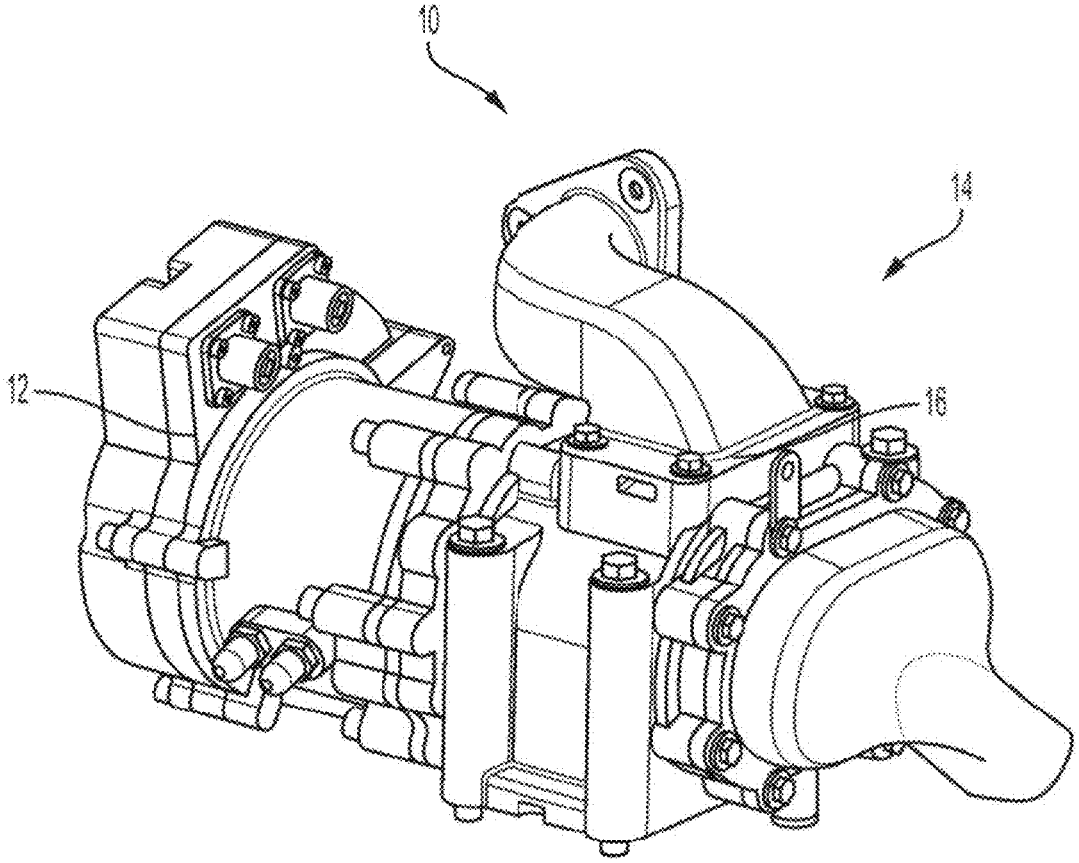
FIG. 1 is a perspective view of an EGR pump and transmission assembly.

Referring to the Figures, there is shown an exhaust gas recirculation pump (EGR pump) system 10. The EGR pump system 10 includes an electric motor 12. A roots device 14 is coupled to the electric motor 12. The Roots device 14 includes a housing 16 that defines an internal volume. Rotors 18 are disposed in the internal volume and are connected to the electric motor 12. In one aspect, the EGR pump system may be vertically orientated with the electric motor 12 positioned vertically above the roots device 14 and rotors 18. In another aspect, the electric motor 12 may be positioned opposite a transmission 50.

The function of the EGR pump system 10 is to deliver exhaust gas from an engine's exhaust manifold to its intake manifold at a rate that is variable and that is controlled. In order to pump exhaust gas, the EGR pump system 10 may use a Roots device 14 coupled to an electric motor 12. The electric motor provides control of EGR flow rate by managing the motor speed and in turn, the pump speed and flow rate of exhaust gas.

Referring to the Figures, the exhaust gas recirculation pump system 10 includes a housing 16 that defines an internal volume that receives the rotors 18. The housing 16 includes a generally elliptical shape that accommodates the lobes of the rotors 18. The housing 16 includes a housing end face 20 linked with a housing sidewall 22. The portion of the housing 24 opposite the end 20 face is open.

Figure 5:
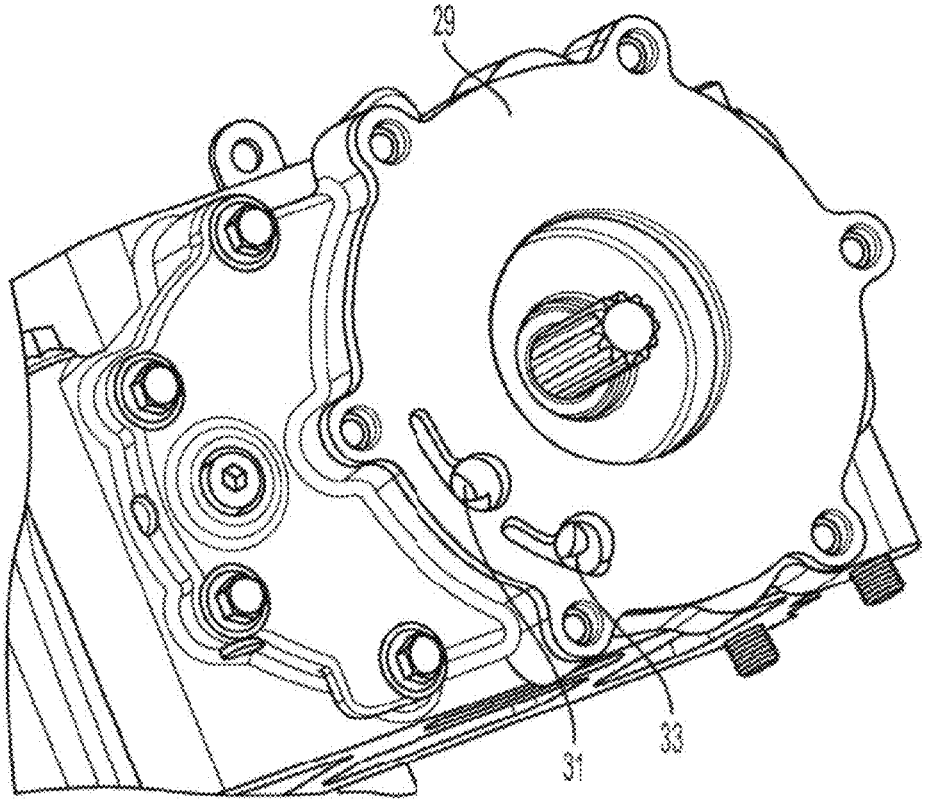
FIG. 5 is a partial perspective view of an EGR pump and transmission assembly showing an coolant seal plate.

The electric motor 12 includes a motor housing 13 having coolant passages 26 formed therein, best seen in FIG. 5. The coolant passages 26 provide heat protection, remove heat from the electric motor 12, and are coupled to a coolant path 30. The coolant path 30 is linked with an engine-cooling path such as coolant from an engine radiator. The coolant enters at the coolant inlet 31 and cools an inverter associated with the electric motor 12. Coolant seals 61 are provided to contain the coolant.

Figure 2:
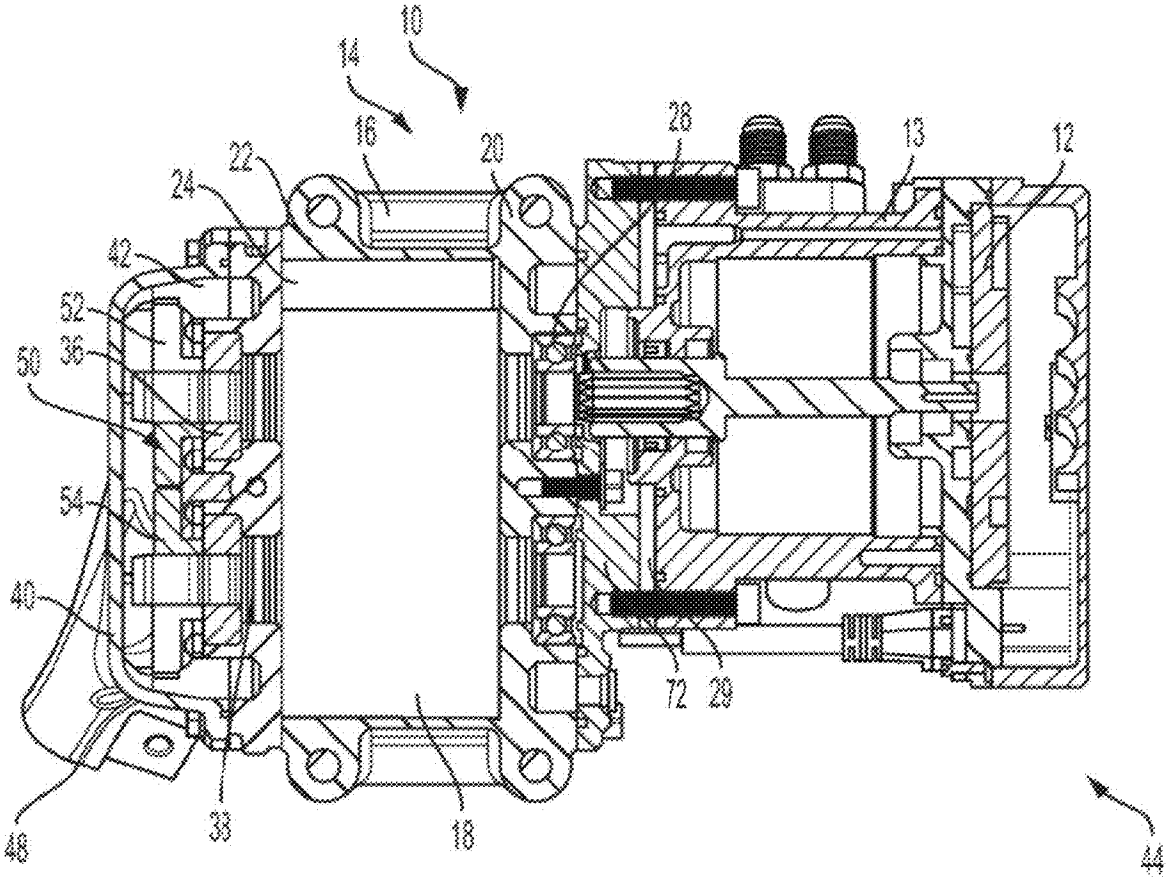
FIG. 2 is a sectional view of an EGR pump and transmission assembly.
Figure 3:
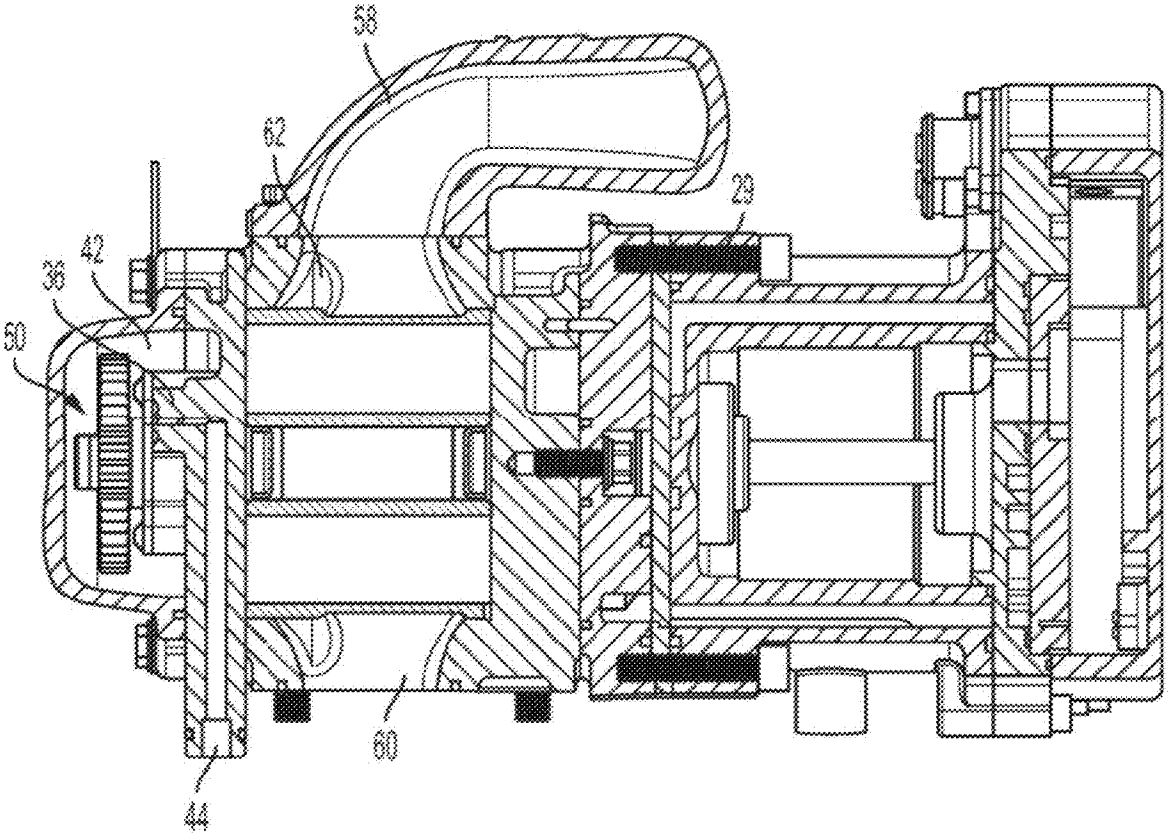
FIG. 3 is a sectional view of an EGR pump and transmission assembly.
Figure 4:
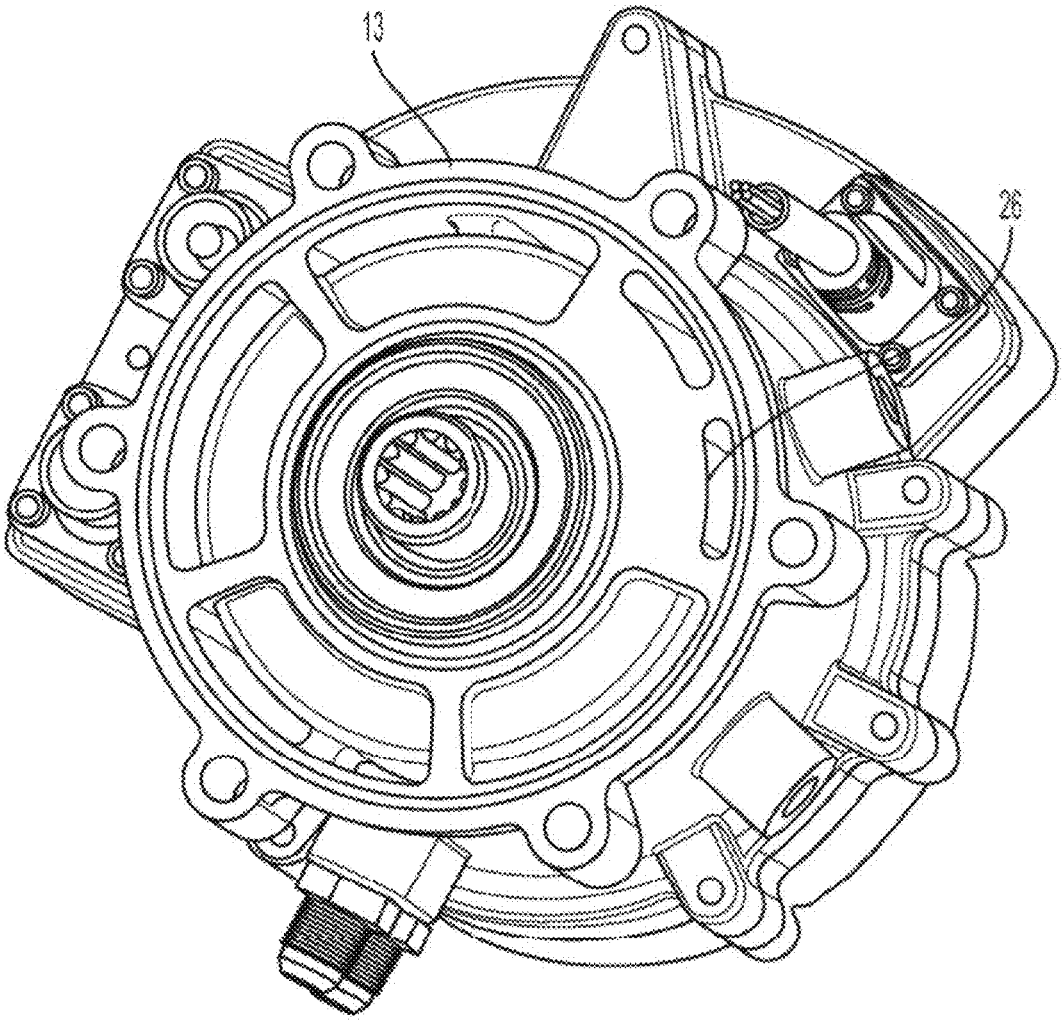
FIG. 4 is a perspective view of an electric motor showing a cooling path.

The electric motor includes a coolant plate 29 attached to the electric motor housing and connected to the housing 16, best seen in FIGS. 2 and 5. The coolant seal plate 29 is attached to the electric motor housing 13 above the motor mounting adapter 72, best seen in FIGS. 2 and 5. The coolant plate 29 includes a coolant inlet and outlet 31, 33.

In one aspect, bearings 28 may be sealed grease bearings. Such bearings 28 do not need an oil lubricant and may eliminate potential oil blowby into the rotor cavity.

Figure 6:
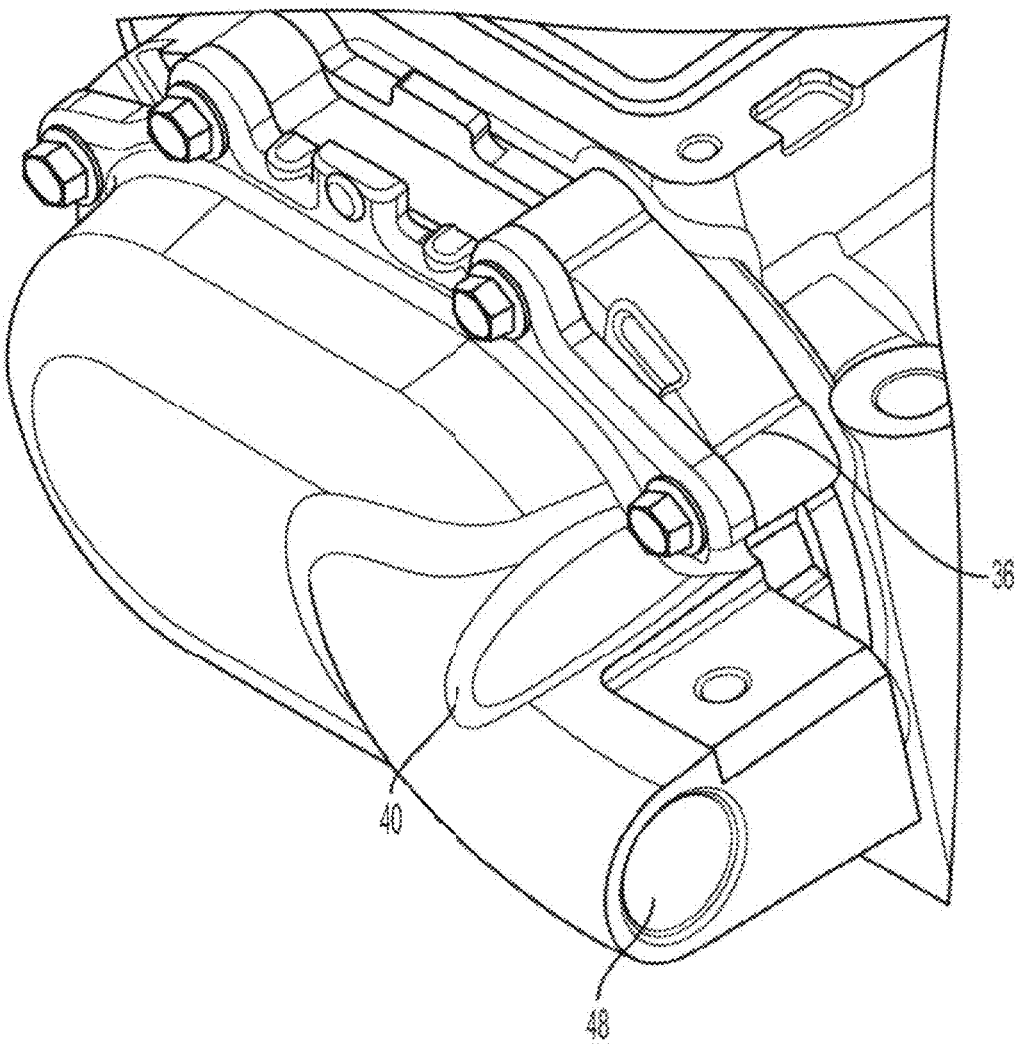
FIG. 6 is a partial perspective view of a cover attached to the bearing plate.
Figure 7:
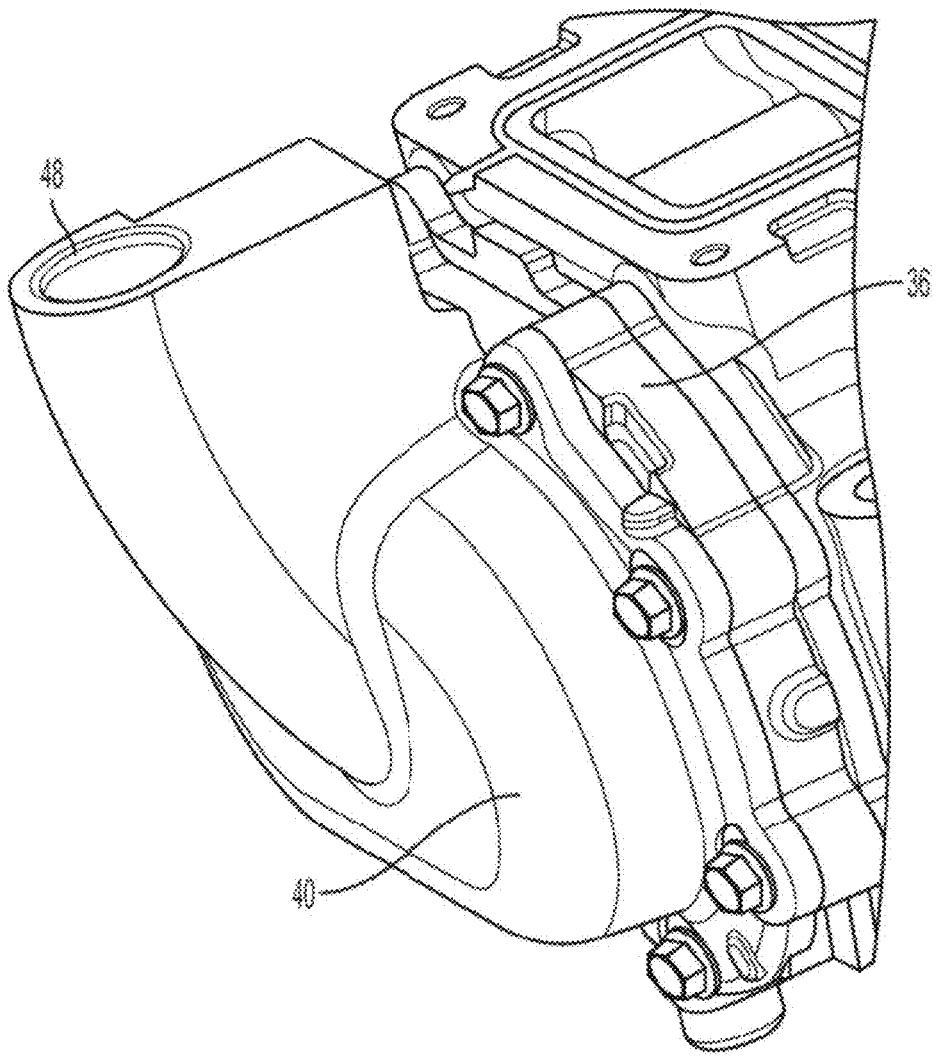
FIG. 7 is a partial perspective view of a cover attached to the bearing plate.
Figure 8:
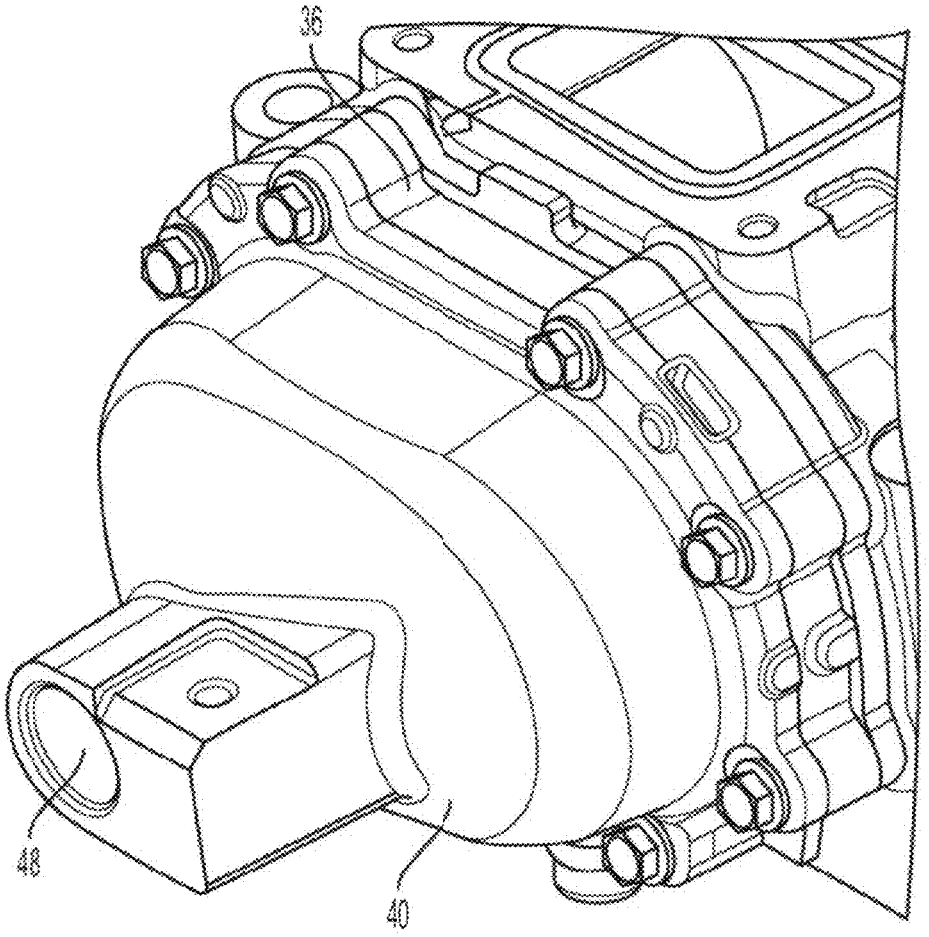
FIG. 8 is a partial perspective view of a cover attached to the bearing plate.
Figure 9:
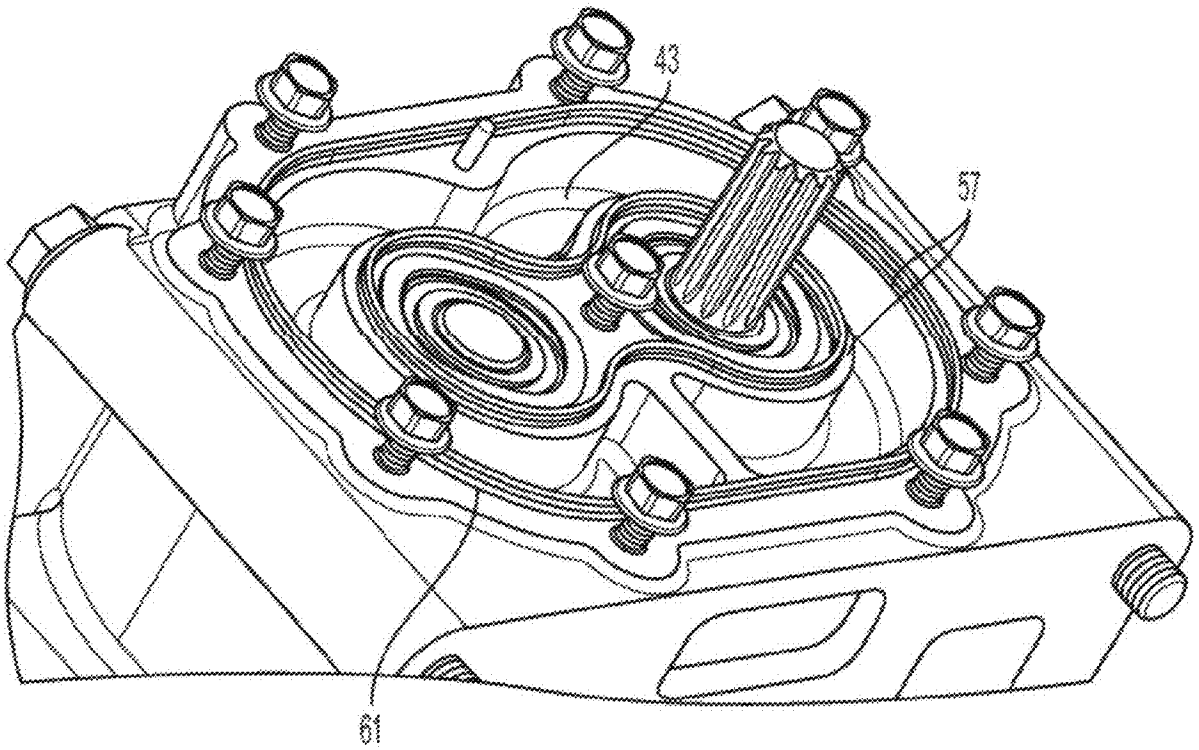
FIG. 9 is a perspective view of an EGR pump and transmission assembly showing an coolant path and housing.

Referring to FIG. 2, the exhaust gas recirculation pump system 10 includes a bearing plate 36 attached to the housing 16. The bearing plate 36 includes journals that receives bearings 38. The bearing plate 36 and outer cover 40 define an oil cavity 42. Various shaped outer covers may be utilized as shown in FIGS. 6-8.

Oil from an engine enters an oil inlet 44 and into the oil cavity 42 for lubricating and cooling the bearings 38 and transmission 50. The bearings 38 may be open type bearings that are lubricated by the oil. The oil exits the oil cavity 42 at a single oil outlet 48. Seals 57 are provided on the bearing plate 36 to seal the oil cavity 42.

Figure 10:
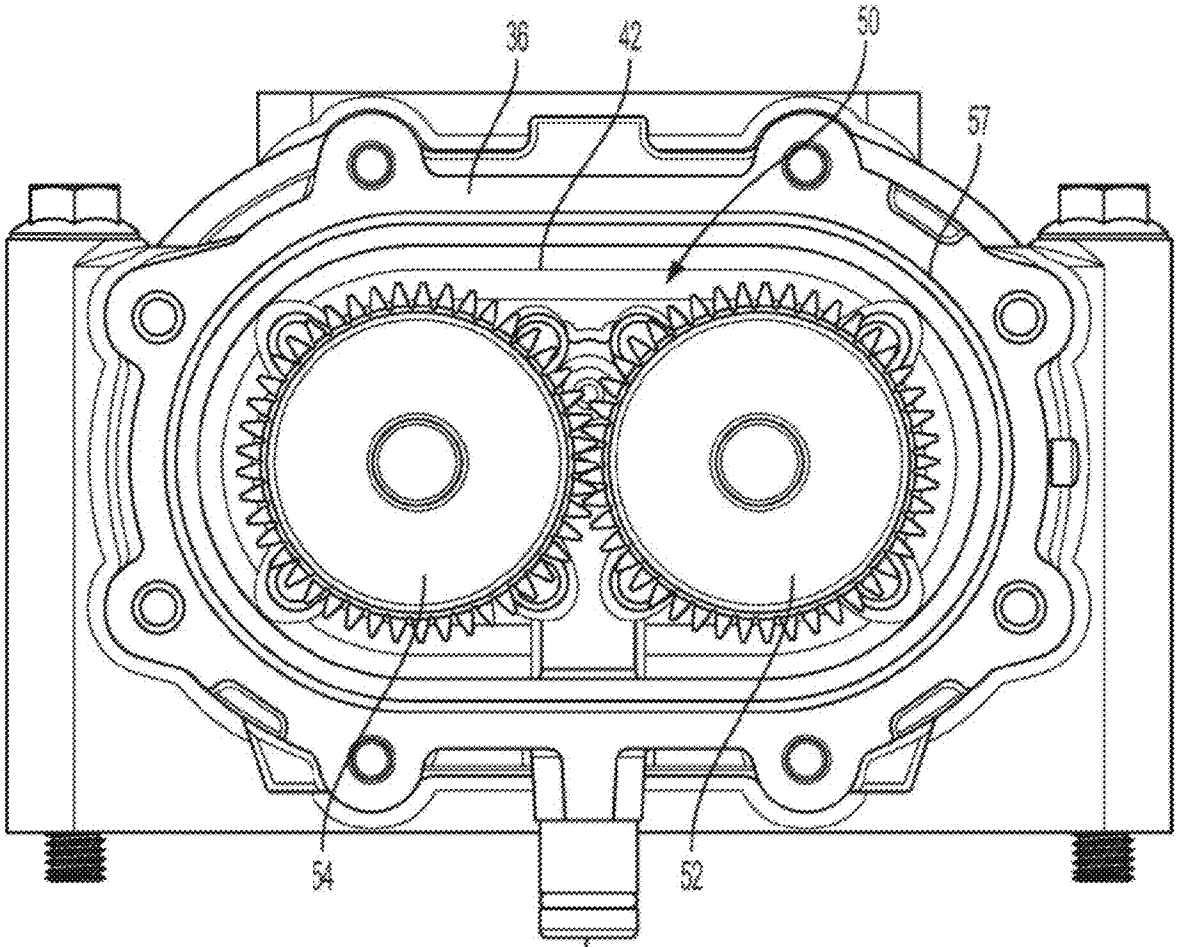
FIG. 10 is a sectional view of an EGR pump and transmission assembly showing an oil path and bearing plate.
Figure 11:
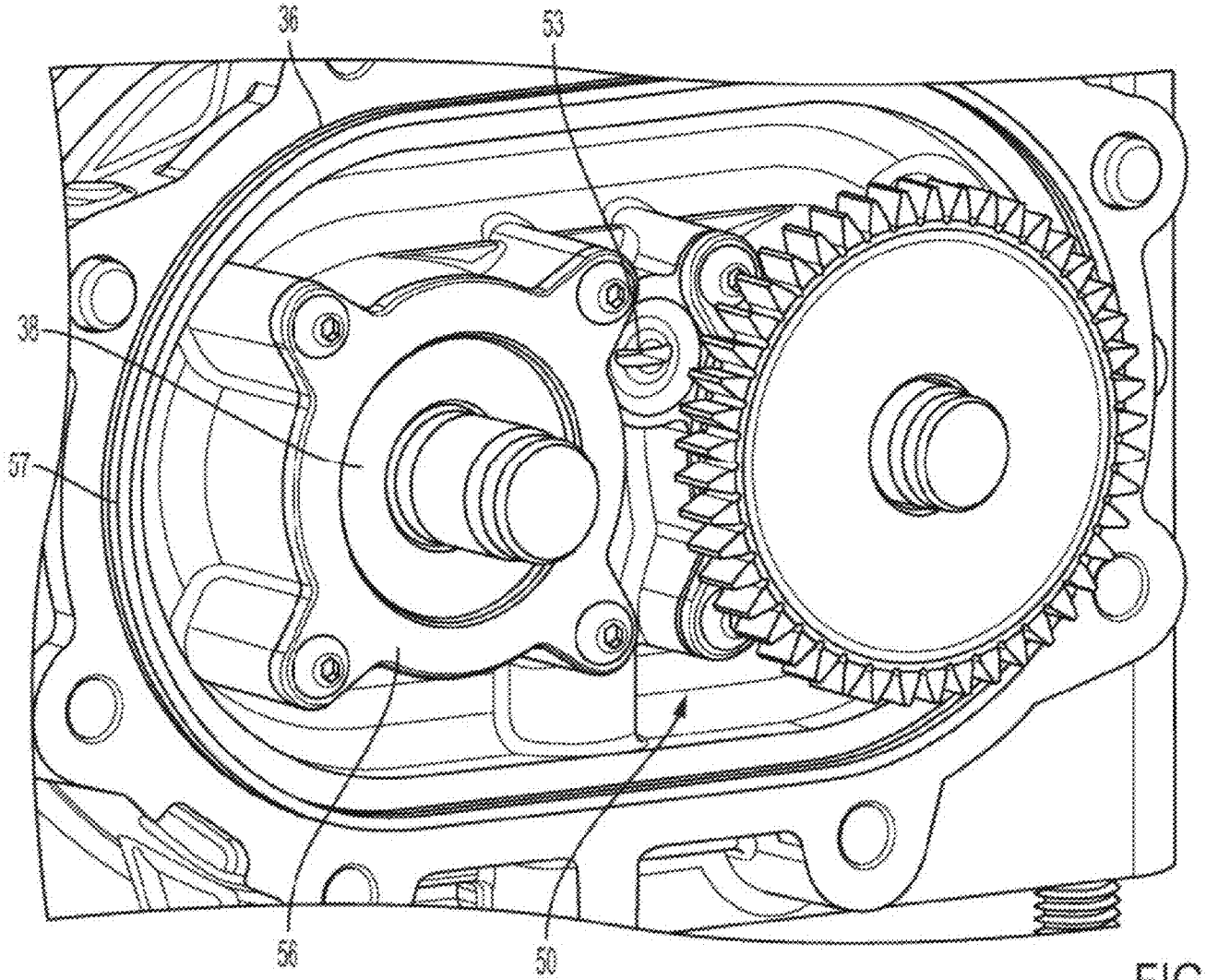
FIG. 11 is a perspective view of an EGR pump and transmission assembly showing an oil path and bearing plate.

Referring to the FIGS. 2 and 10-11, the exhaust gas recirculation pump system 10 includes a transmission assembly 50 that includes a drive gear 52 that is meshed with a driven gear 54. The drive gear 52 is coupled to the rotor 18, which in turn is connected to a shaft of the electric motor 12. The driven gear 54 is meshed with the drive gear 52 and is coupled to the other rotor 18. In one aspect, the transmission assembly 50 is positioned on an opposing side of the housing 16 relative to the electric motor 12 and within an oil cavity 42. A transmission retainer plate 56 is provided about the bearings 38 and attached to the bearing plate 36 to prevent lateral movement of the bearings 38 and transmission 50.

Oil may be introduced into the transmission area using a variety of oil dispersing structures. Referring to FIG. 11, the oil dispersing structure may be an oil slot 53 formed in the bearing plate 36. Oil will be moved through the slot and contact the drive gear 52 and driven gear 54 to lubricate the gears and the bearings 38.

Figure 12:
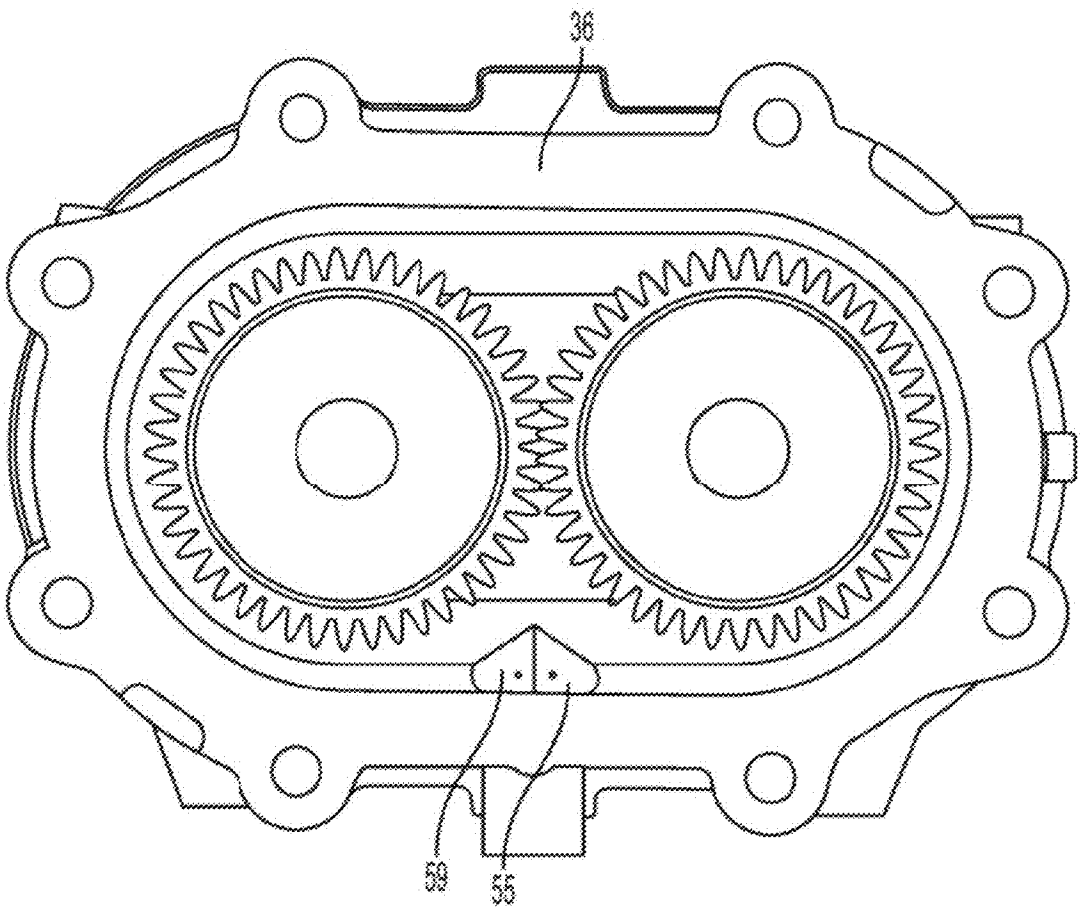
FIG. 12 is a partial perspective view of bearing plate showing an oil path.

Referring to FIG. 12, the oil dispersing structure may be an oil conduit 55 that is positioned at a lower portion of the oil cavity 42 and formed in the bearing plate 36. The oil conduit may include holes 59 such that oil will be moved through the holes and contact the drive gear 52 and driven gear 54 to lubricate the gears and the bearings 38.

Figure 14:
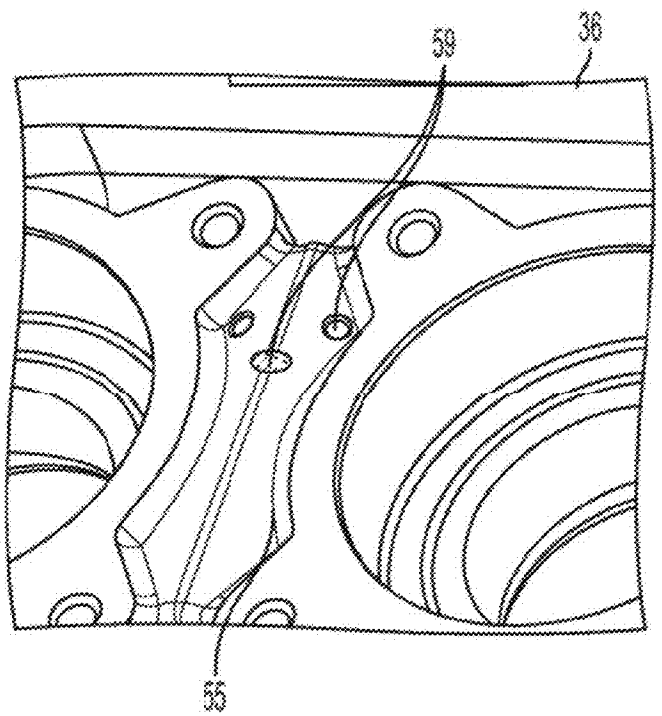
FIG. 14 is a partial perspective view of bearing plate showing an oil path.
Figure 13:
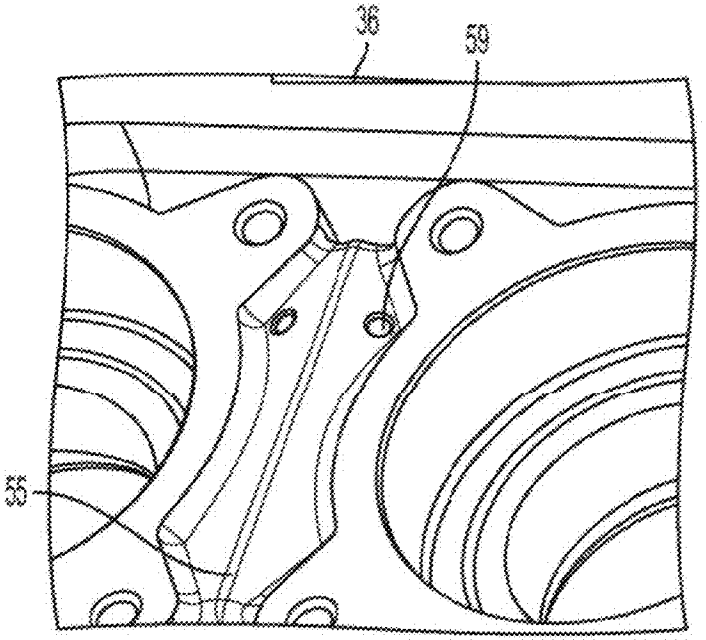
FIG. 13 is a partial perspective view of bearing plate showing an oil path.

Referring to FIG. 13, the oil dispersing structure may be an oil conduit 55 that is positioned at an upper portion of the oil cavity 42 and formed in the bearing plate 36. The oil conduit may include holes 59 such that oil will be moved through the holes and contact the drive gear 52 and driven gear 54 to lubricate the gears and the bearings 38. The depicted embodiment of FIG. 14 is the same as FIG. 13 with the addition of an additional hole 59.

Figure 16:
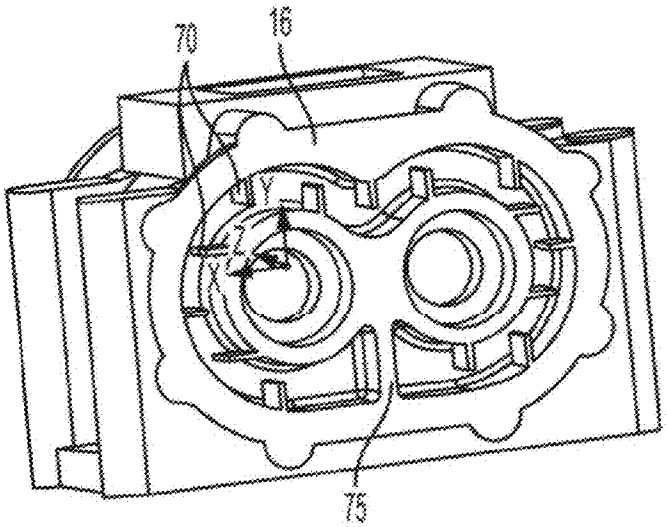
FIG. 16 is a partial perspective view of housing showing an coolant path and fins.
Figure 15:
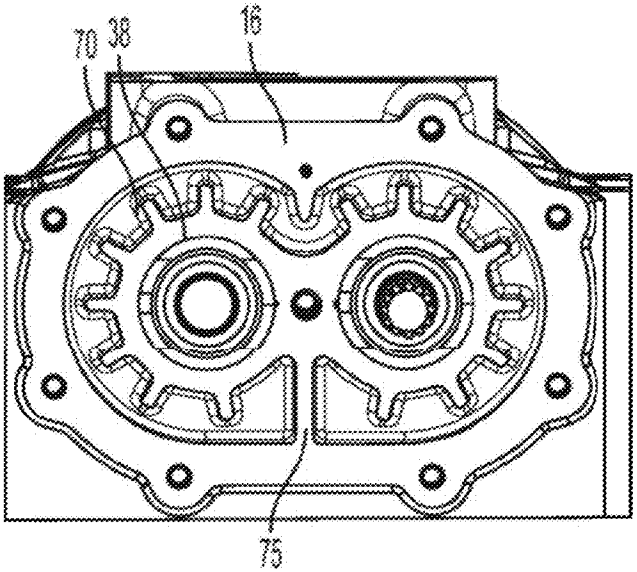
FIG. 15 is a partial sectional view of housing showing an coolant path and fins.
Figure 18:
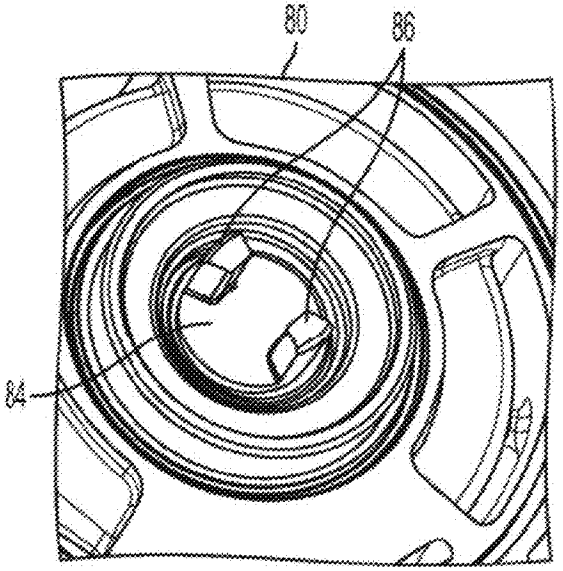
FIG. 18 is a partial perspective view of a coupling on an electric motor shaft.
Figure 17:
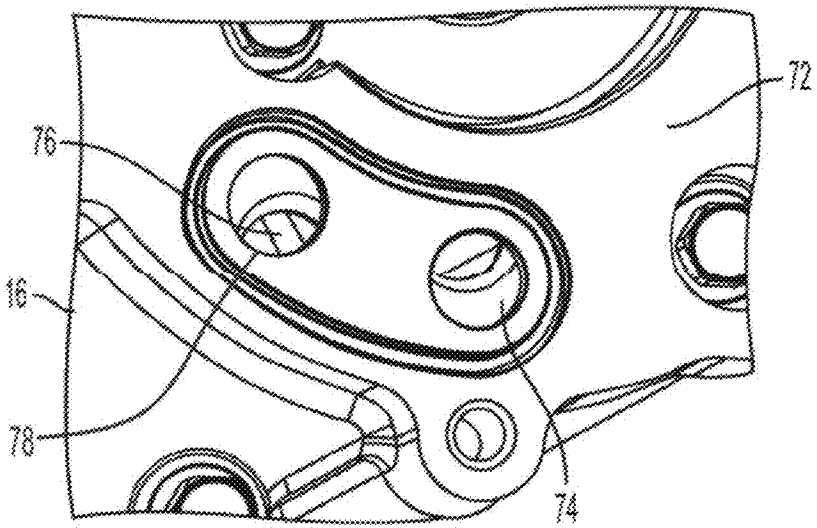
FIG. 17 is a partial perspective view of coolant sealing path showing an coolant inlet and coolant outlet.
Figure 19:
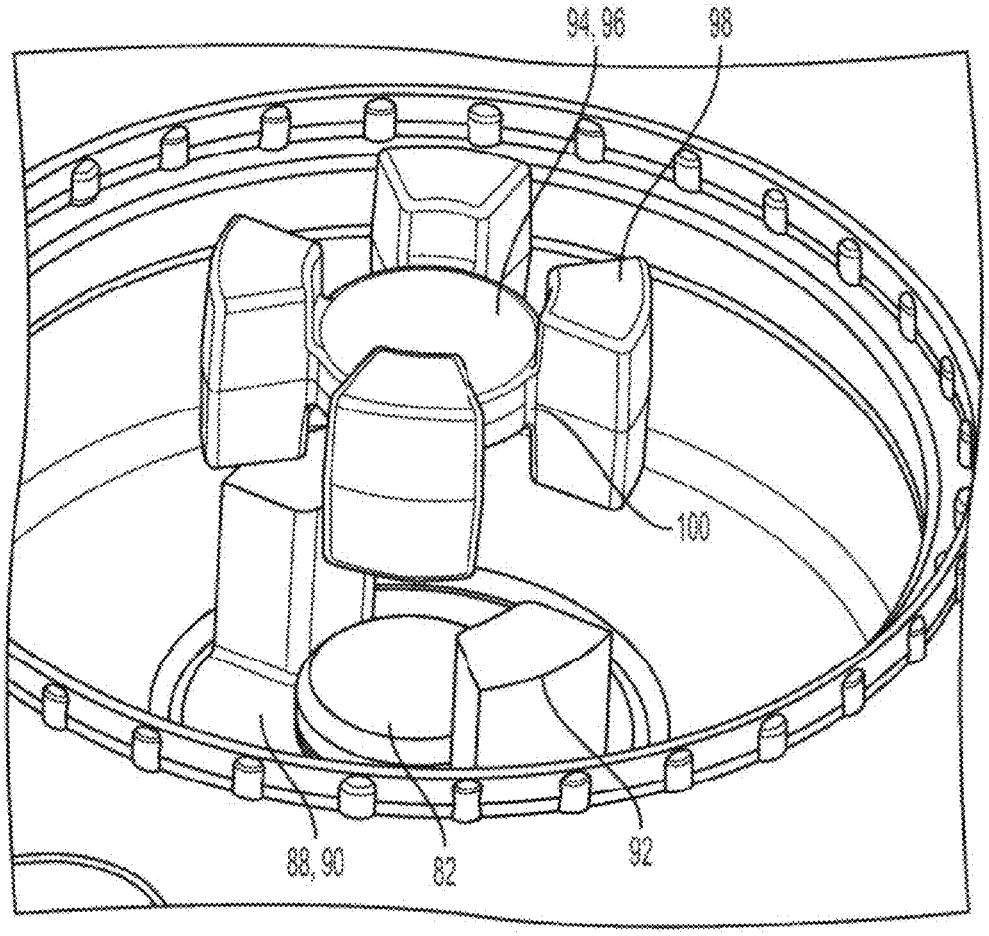
FIG. 19 is a partial perspective view of a coupling on an rotor shaft and including a connector.

Referring to FIGS. 15-17 there is depicted an alternative structure of the housing 16. In the depicted embodiment, the housing 16 includes fin structures 70 formed thereon. The fin structures 70 increase the surface area for contact with the coolant to increase extraction of heat from the housing 16 due to the hot EGR gas in the EGR pump. The fin structures 70 also increases turbulent mixing of the coolant also increasing the heat transfer from the housing 16. The fin structures may be formed in various patterns about the bearings 38. In the depicted embodiment of FIG. 15 the fins 70 are dispersed radially about the bearings 38. In the depicted embodiment of FIG. 16, the fins 70 are formed about the bearings 38 and perpendicular to the bearings 38. The fins 70 are also formed on the housing 16 perpendicularly towards the bearings 38.

The housing 16 includes a motor mounting adapter 72, best seen in FIG. 17. A coolant inlet and coolant outlet 74, 76 are formed in the motor mounting adapter 72 to introduce coolant into coolant cavity 43 and to define a flow path for the coolant. The coolant inlet and coolant outlet 74, 76 are formed on opposing sides of a separator 75. The coolant inlet and outlet 74, 76 are defined by bores 78 formed through the adapter 72. The bores 78 may be formed at an angle such they are not perpendicular relative to the adapter 72.

Referring to FIGS. 17-20, there is shown an insulated coupling 80 joining a rotor shaft 82 to an electric motor shaft 84. The insulated coupling 80 prevents heat transfer from the rotor 18 and rotor shaft 82 to the electric motor 12. In one aspect, the insulated coupling 80 is formed of a polymer material such as polyimide which may include reinforcing materials such as carbon fiber or glass fibers.

Figure 20:
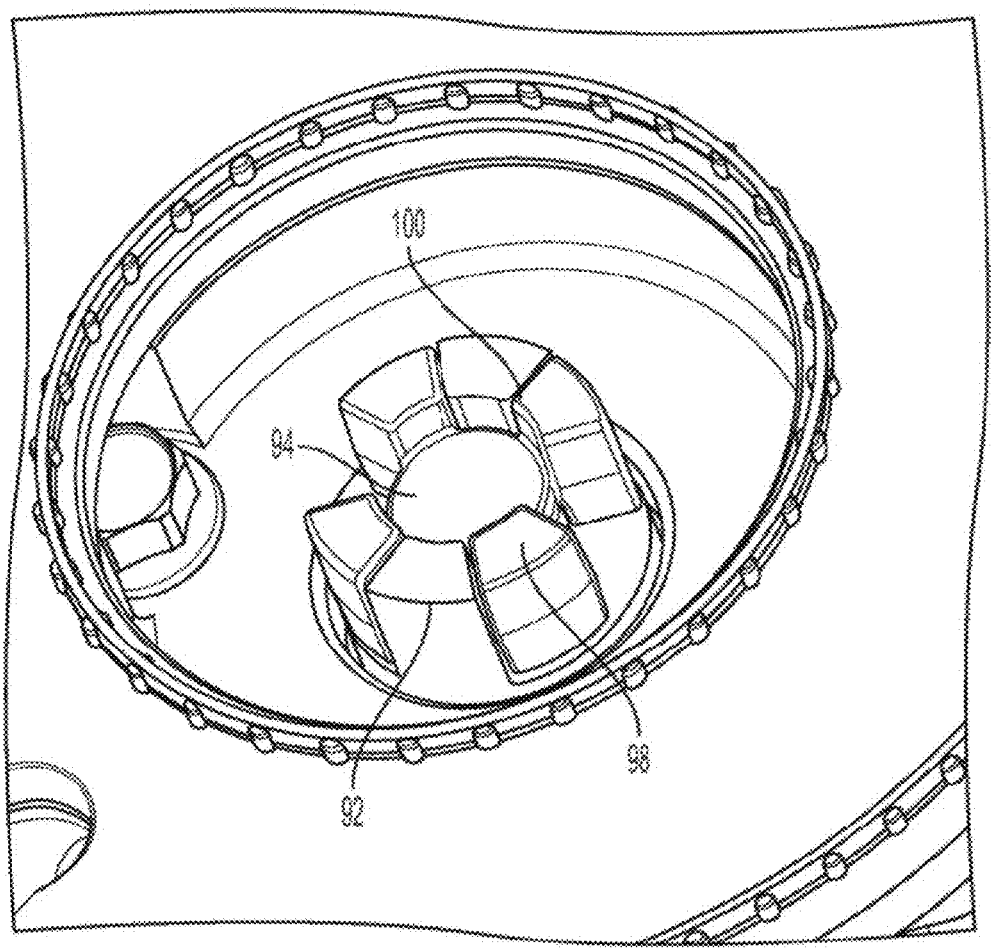
FIG. 20 is a partial perspective view of a coupling on a rotor shaft and including a connector.

In one aspect, the insulated coupling 80 includes a pair of separated extending wedges 86 formed on the electric motor shaft 84. A rotor shaft hub 88 includes a circular body 90 that is attached to the rotor shaft 82. A pair of separated extending wedges 92 extends from the circular body 90. A connector 94 links the extending wedges 86 and 92. The connector 94 includes a central circular body 96 having wedge shaped bodies 98 formed radially about a perimeter. The wedge shaped bodies 98 define openings 100 into which extending wedges 86 and 92 are positioned to couple the rotor shaft 82 and electric motor shaft 84, as shown in FIG. 20. The insulated coupling 80 connects the electric motor 12 to the rotors 18 and prevents heat transfer. In some examples, the extending wedges 86 and the extending wedges 92 may be referred as having a tapered shape and/or being tapered members. In some examples, the wedge shaped bodies 98 may be referred to as having a tapered shape and/or being tapered bodies.

The EGR gas outlet adapter 58 is attached to the housing 16 for routing EGR gases exiting the EGR pump 10. In one aspect, the outlet adapter 58 is modular such that various shapes can be attached to the EGR pump 10 for different engine configurations. The EGR gas inlet 60 and outlet 62 may be reversed for different configurations.

The invention claimed is:

1. An exhaust gas recirculation pump for an internal combustion engine comprising:

an electric motor assembly including an electric motor disposed within an electric motor housing, the electric motor housing including a coolant passageway;

a roots device coupled to the electric motor, the roots device including a roots device housing defining an internal volume;

two rotors disposed in the internal volume, one of the two rotors being connected to the electric motor;

an insulated coupling joining a rotor shaft to an electric motor shaft, and a transmission assembly including a drive gear attached to the rotor coupled to the electric motor, the transmission assembly including a driven gear meshed with the drive gear, the driven gear coupled to the other rotor of the two rotors, wherein the transmission assembly is positioned on an opposing side of the roots device housing relative to the electric motor;

wherein the roots device housing includes a coolant cavity at least partially surrounding a first set of bearings of the rotors, the first set of bearings supporting the rotors, and wherein the coolant cavity is in fluid communication with the coolant passageway of the electric motor housing;

wherein the insulated coupling includes a pair of separated extending tapered members formed on the electric motor shaft, wherein the insulated coupling includes a rotor shaft coupling including a circular body that is attached to the rotor shaft and a pair of separated extending tapered members extending from the circular body, wherein the insulated coupling includes a connector linking the extending tapered members of the rotor shaft and the electric motor shaft, the connector including a central circular body having tapered bodies formed radially about a perimeter, wherein the tapered bodies of the connector define openings into which the extending tapered members of the rotor shaft and the electric motor shaft are positioned to couple the rotor shaft and the electric motor shaft.

2. The exhaust gas recirculation pump of claim 1 further including a bearing plate attached to the roots device housing, the bearing plate including journals formed therein receiving a second set of bearings.

3. The exhaust gas recirculation pump of claim 2, wherein the bearing plate and an outer cover attached to the bearing plate define an oil cavity.

4. The exhaust gas recirculation pump of claim 3, wherein the transmission assembly is positioned in the oil cavity.

5. The exhaust gas recirculation pump of claim 3, wherein the bearing plate includes a portion of an oil path formed therein, the oil path including an oil inlet extending to a single oil outlet, said oil inlet and said oil outlet coupled to an engine oil circulation system, wherein the oil path lubricates the second set of bearings and the transmission assembly.

6. The exhaust gas recirculation pump of claim 5, wherein oil is introduced into the oil cavity from an oil slot formed in the bearing plate.

7. The exhaust gas recirculation pump of claim 5, wherein oil is introduced into the oil cavity from an oil conduit formed in the bearing plate at a lower portion of the oil cavity, the oil conduit including holes formed therein.

8. The exhaust gas recirculation pump of claim 5, wherein oil is introduced into the oil cavity from an oil conduit formed in the bearing plate at an upper portion of the oil cavity, the oil conduit including holes formed therein.

9. The exhaust gas recirculation pump of claim 2 including a transmission retainer plate positioned about the second set of bearings and attached to the bearing plate.

10. The exhaust gas recirculation pump of claim 2, wherein the roots device housing includes fin structures formed thereon about the second set of bearings.

11. The exhaust gas recirculation pump of claim 10, wherein the fin structures are formed radially about the second set of bearings.

12. The exhaust gas recirculation pump of claim 10, wherein the fin structures are formed about the second set of bearings and perpendicular to the second set of bearings.

13. The exhaust gas recirculation pump of claim 10, wherein the fin structures are formed on the bearing plate perpendicularly toward the second set bearings.

14. The exhaust gas recirculation pump of claim 10, further including an adapter, a coolant inlet, and a coolant outlet formed in the adapter introducing coolant and defining a flow path for the coolant.

15. The exhaust gas recirculation pump of claim 14, wherein the coolant inlet and the coolant outlet are formed on opposing sides of a separator.

16. The exhaust gas recirculation pump of claim 14, wherein the coolant inlet and the coolant outlet are defined by bores, wherein each bore is formed through the adapter at an angle, such that a length of each bore is not angled perpendicularly relative to the adapter.

17. An exhaust gas recirculation pump for an internal combustion engine comprising:

an electric motor assembly including an electric motor disposed within an electric motor housing, the electric motor housing including a coolant passageway;

a roots device coupled to the electric motor, the roots device including a roots device housing defining an internal volume;

rotors disposed in the internal volume, one of the rotors being connected to the electric motor;

a bearing plate attached to the roots device housing, wherein the bearing plate and an outer cover attached to the bearing plate define an oil cavity;

a transmission assembly positioned on an opposing side of the roots device housing relative to the electric motor and in the oil cavity;

an adapter including a coolant inlet and a coolant outlet for introducing coolant and defining a coolant cavity for the coolant, wherein the coolant cavity is in fluid communication with the coolant passageway; and an insulated coupling joining a rotor shaft to an electric motor shaft, wherein the insulated coupling includes a pair of separated extending tapered members formed on the electric motor shaft, wherein the insulated coupling includes a rotor shaft coupling including a circular body that is attached to the rotor shaft and a pair of separated extending tapered members extending from the circular body, wherein the insulated coupling includes a connector linking the extending tapered members of the rotor shaft and the electric motor shaft, the connector including a central circular body having tapered bodies formed radially about a perimeter, wherein the tapered bodies of the connector define openings into which the extending tapered members of the rotor shaft and the electric motor shaft are positioned to couple the rotor shaft and the electric motor shaft.

* * * * *